United States Patent [19]

Björnberg et al.

[11] Patent Number: 4,626,279

[45] Date of Patent: Dec. 2, 1986

[54] METHOD FOR PROCESSING COPPER SMELTING MATERIALS AND THE LIKE CONTAINING HIGH PERCENTAGES OF ARSENIC AND/OR ANTIMONY

[75] Inventors: Arne Björnberg, Skelleftehamn; S. Åke Holmström, Ursviken; Göran Lindkvist, Skelleftehamn, all of Sweden

[73] Assignee: Boliden Aktiebolag, Stockholm, Sweden

[21] Appl. No.: 609,989

[22] Filed: May 14, 1984

[30] Foreign Application Priority Data

Jun. 6, 1983 [SE] Sweden ..... 8303184

[51] Int. Cl.[4] ..... C22B 1/02

[52] U.S. Cl. ..... 75/2; 75/69; 75/70; 75/72; 75/83; 423/22; 423/23; 423/88

[58] Field of Search ..... 423/87, 88, 29, 22, 423/23; 75/69, 117, 2, 70, 118 R, 72, 121, 83

[56] References Cited

U.S. PATENT DOCUMENTS

| | | | |
|---|---|---|---|
| 3,174,848 | 3/1965 | Bruce | 75/69 |
| 4,118,220 | 10/1978 | Von Dreusche, Jr. et al. | 75/69 |
| 4,431,614 | 2/1984 | Makipirtti et al. | 423/29 |

FOREIGN PATENT DOCUMENTS

| | | |
|---|---|---|
| 3003635 | 8/1981 | Fed. Rep. of Germany . |
| 668119 | 3/1952 | United Kingdom . |
| 677050 | 8/1952 | United Kingdom . |

*Primary Examiner*—John Doll
*Assistant Examiner*—Robert L. Stoll
*Attorney, Agent, or Firm*—Burns, Doane, Swecker & Mathis

[57] ABSTRACT

The invention relates to a method for preparing a sulphidic concentrate which is intended for further processing to copper and/or precious metals and which contains high percentages of arsenic and/or antimony, and possibly also bismuth in quantities likely to disturb subsequent processing stages, by partially roasting the concentrate in a fluidized bed, so as to eliminate substantially all the arsenic present and a major part of the antimony and/or bismuth. According to the invention, the concentrate and gas are supplied to a fluidized-bed reactor, and are there heated to a minimum temperature above the splitting or decomposition temperatures of the complex minerals containing arsenic and/or antimony and bismuth present in the concentrate. The oxygen potential in the reactor is regulated, so as to prevent the formation of non-volatile compounds of said impurities. The residence time of the concentrate in the reactor is controlled in a manner to ensure a given minimum elimination of the impurities. The gas and solids are withdrawn from the reactor and passed to a separating means, in which substantially impurity-free solids can be separated from the gas. The aforesaid minimum temperature and said regulated oxygen potential are maintained while the solids are in contact with said gas, and at least a part of the separated solids is returned to the reactor, for controlling the residence time, and an end product is removed from the fluidized bed and/or the separating means. The method is suitably carried out in one stage in a fluidized-bed reactor having a circulatory fluidized bed, although in certain cases the method can be carried out in two stages, in mutually separate reactors.

13 Claims, 3 Drawing Figures

METHOD FOR PROCESSING COPPER SMELTING MATERIALS AND THE LIKE CONTAINING HIGH PERCENTAGES OF ARSENIC AND/OR ANTIMONY

The present invention relates to a method for bringing sulphidic concentrates which contain high percentages of arsenic and/or antimony and which also possibly contain bismuth in quantities which are likely to disturb subsequent processing stages, to a state in which copper and/or precious metals can be recovered from said concentrates by heating the concentrate in a fluidized bed, to eliminate substantially all the arsenic and the majority of the antimony and/or the bismuth present. Subsequent to being prepared in accordance with the invention, the concentrate can be further processed pyrometallurgically, for example in copper smelter, or can be processed (worked-up) totally or partially hydrometallurgically, for example by chloride or cyanide leaching processes, subsequent to roasting the concentrate to substantially eliminate all sulphur present, or by subjecting the concentrate to an RSLE-process (roasting-sulphating-leaching-electrowinning), in order to recover therefrom precious metals and such valuable metals as copper, nickel for example. By "concentrate" it is here and hereinafter meant the fine-grained mineral product obtained from a modern ore dressing plant. The average particle size of the mineral product is well below 1 mm, and may often be so low as 1–10 μm.

Concentrates intended for the production of copper and precious metals become more and more complex as the access to "pure" finds decreases. The majority of copper plants are only able to accept limited quantities of such major contaminants as arsenic, antimony and bismuth. These elements are either poisonous or have a deleterious affect on the result of the processing, e.g. on the quality of the coopper produced, and should consequently be removed in the copper process as soon as possible. Traditionally, these contaminating elements are removed by roasting them off in multi-hearth furnaces. Such a conventional multi-hearth process for the removal of arsenic from non-ferrous metal ores is disclosed in No. DE-A-30 03 635.2, wherein the process provides oxidizing the expelled gaseous elementary arsenic in a second reactor, which may be shaped as a fluidized-bed reactor. In respect of the requirements placed on a modern copper plant with regard to capacity and internal and external environmental care, such furnaces have many serious drawbacks. For example, they have a low throughput, are liable to heavy wear and tear, require almost constant maintenance, can only be started up quickly with great difficulty, and create a highly dangerous working environment.

Since the beginning of the 1950's the majority of the new generation of the roasters have the form of fluidized bed furnaces, which are in the majority of cases, superior to multi-hearth roasters. Although the majority of fluidized bed roasters have been designed for roasting pyrite to iron oxide and for roasting zinc blende to zinc oxide, a number have also been used for partially roasting chalcopyrite concentrates, i.e. for roasting the concentrates to a sulphur content at which the concentrates can be further processed. The sulphur content of the roasted solids, i.e. the cinder or calcine is controlled in dependence on, for example, how much copper is desired in the sulphide melt or the matte formed in a subsequent smelting process, a low residual sulphur content of the calcine resulting in a richer matte, since substantially all the iron present will then be slagged. Normally, however, the elimination of arsenic, antimony and bismuth is much poorer in fluidized bed roasters than in multi-hearth roaster, since in fluidized bed roasters parallel flow conditions prevail, which inhibit heat transfer from the solid phase to the parallel-flowing fluidizing gas, as opposed to the counterflow conditions of multi-hearth roasters. Consequently, in the majority of cases, it has hitherto been necessary to regulate the quality of the roasted solids by restricting the impurity level of the concentrate. Arsenic-containing non-ferrous concentrates have not been possible to be roasted in fluidized-beds due to what is said above and to the limited residence time provided by the fluidizing technique when processing fine-grained materials, such as concentrates. It has, however, been possible to roast *coarse* arsenic-containing non-ferrous ores of the type generally designated as sorted or clean ores, i.e. ore crushed to mechanically free the minerals from the gangue. The particle size in this process is at least 5 mm. It is disclosed in No. GB-A-677 050, such a roasting process employing a two-stage fluidized roasting, but which presumes a residence time of about 18 hours in the first stage that provides partial roasting.

It is also known to roast pyrite concentrates in one or more stages in a fluidized bed, in order to drive off the arsenic present. Our earlier patent specifications U.S. Pat. No. 3,386,815, No. DE-C-2000085.2 and U.S. Pat. No. 3,955,960, for example, describe methods in which concentrates containing at most up to about 1% arsenic can be roasted to a level acceptable with regard to the further processing of the pyrite cinder (which consists of iron oxides). Both the input material and the outgoing product, however, differ quite considerably with pyrite roasting and partial roasting of copper sulphide concentrates. Among other things, as previously indicated, pyrite normally contains less than 1% arsenic, and the amount of antimony and bismuth present is often lower, while the arsenic content of complex copper concentrate or precious metal concentrates is normally greater than 5%, and at times as much as 25–30%, and even higher. These concentrates may also contain significant amounts of antimony and/or bismuth. In the case of pyrite roasting processes, the end product, i.e. the cinder, is substantially oxidic, while in the case of copper-concentrate roasting processes, the partially roasted solids, i.e., the calcine, is mainly sulphidic. Thus, when copper concentrate containing a high percentage of impurities such as arsenic and/or antimony is partially roasted in a fluidized bed roaster, the percentage of residual impurities is so high as to be unacceptable in the further processing stages, resulting in troublesome disturbances in certain unit processes, such as electrolysis, and also impairing the quality of the metal produced. In addition hereto, serious environmental problems are created in a number of the smelting process stages, from the roasting and smelting stages right down to the electrolysis or electrowinning stage, where excessive quantities of arsenic give rise to highly poisonous arsenic hydride (arsine). Antimony and bismuth can also have a disturbing effect on the processes, and can impair the quality of the metal produced.

Because of the aforesaid increasing complexity of copper and precious metal concentrates containing high percentages of arsenic, antimony and bismuth, there is a great need for a method which will enable such highly impure concentrates to be brought to a state in which they are better suited for further processing. More specifically, there is a need for a roasting process which satisfies modern requirements with regard to productivity, clean working environments and conditions, and which can deal with the ever more complex concentrates.

In respect of complex concentrates of the aforesaid kind, arsenic is mostly present in one or more of the minerals arsenopyrite (FeAsS), enargite ($Cu_3AsS_4$), realgar ($As_4S_4$) and orpiment ($As_2S_3$), and in more complex minerals also containing antimony, for example tetrahedrite ($Cu_3SbS_3$), better known under its German name ∓fahlerz". Other antimony-containing minerals which can be found in the aforesaid complex concentrates include gudmundite (FeSbS), bertierite ($FeSb_2S_4$), boulangerite ($Pb_5Sb_4S_{11}$), bournonite ($CuPbSbS_3$) and jamesonite ($Pb_4FeSb_6S_{14}$).

BRIEF DESCRIPTION OF THE DRAWINGS

FIG. I shows a phase diagram for roasting complex minerals to eliminate arsenic, antimony, and bismuth as a function of temperature and oxygen potential.

FIG. II shows a phase diagram for the limits for a system Me-S-O at a temperature 1000K as a function of oxygen and $SO_2$ pressures.

Figure 1:
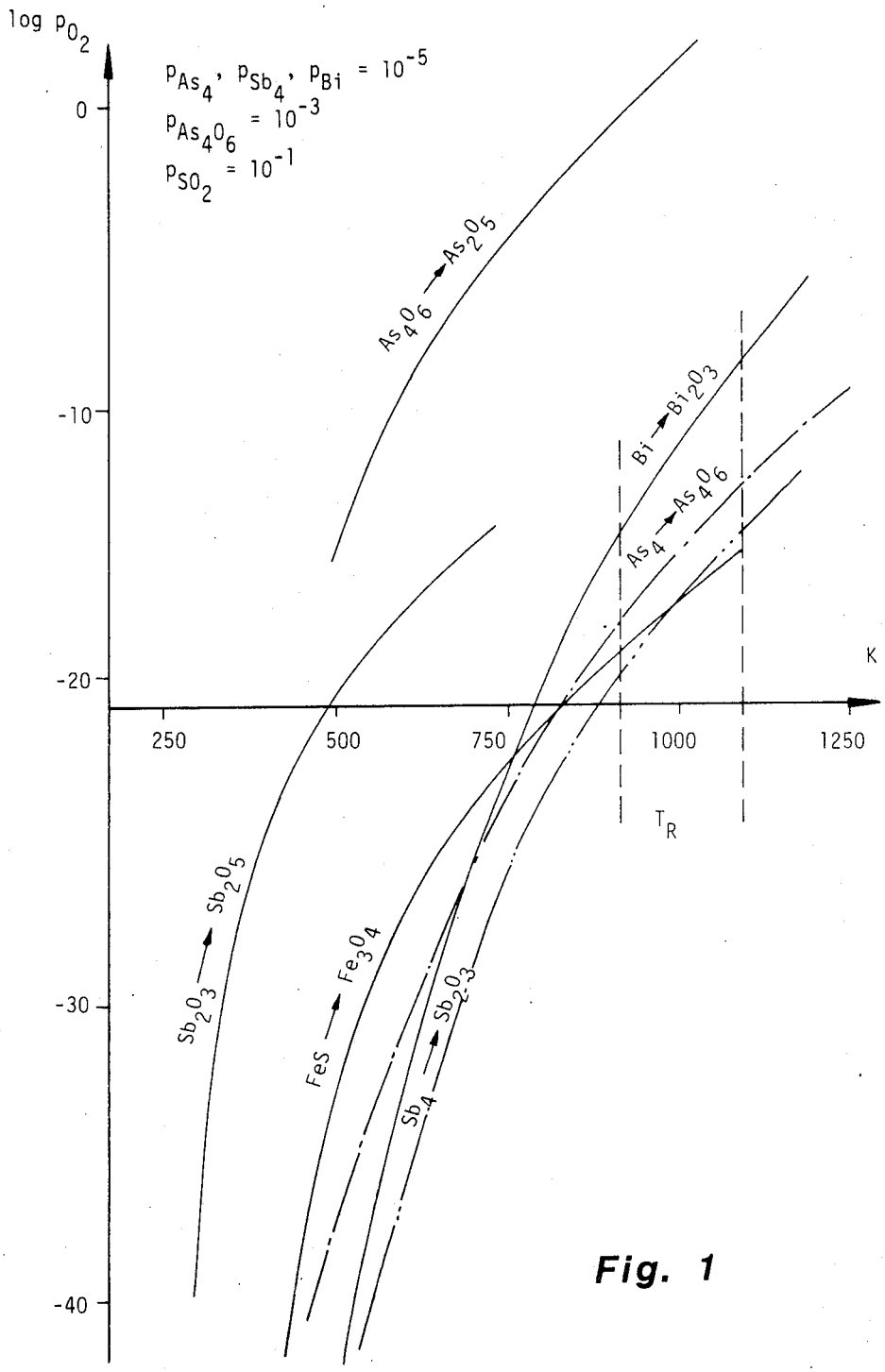

FIG. III illustrates an arrangement of apparatus for carrying out a preferred method of the invention.

It has now surprisingly been found that complex concentrates of the kind mentioned can be prepared for further processing, while partially roasting the concentrates in a fluidized bed. The roasting process enables large quantities of arsenic and/or antimony to be eliminated, together with any bismuth present, and also enables sufficient sulphur to be retained in the roasted solids for further processing thereof. The invention is characterized more specifically by the features set-forth in the following claims.

Thus, in accordance with the method of the invention the concentrate and fluidizing gas are fed to a fluidized bed reactor, and there heated to a minimum temperature which exceeds the decomposition or splitting temperature of such complex minerals present in the concentrate as those which contain arsenic and/or antimony and bismuth, so as to convert the complex minerals to simpler compounds. This treatment, hereinafter called decomposition, can be carried out in either an oxidizing, a neutral, or a reducing environment, as discussed hereinafter. The decomposition temperature is determined, inter alia, by the nature of the complex minerals present in the concentrate, and partly also by the atmosphere prevailing during the decomposition process. For example, arsenopyrites split-off in a neutral atmosphere following the reaction $$4FeAsS \rightarrow 4FeS + As_4 \quad (1)$$

This decomposition of the complex minerals to simpler compounds, however, is quickest in a more oxidizing atmosphere, although excessively high oxygen potentials counter-act the decomposition process, due to the fact that the outer shell of each pyrite particle will, instead, be converted to a stable, non-volatile iron arsenate, in accordance with the reaction $$FeAsS + 3O_2 \rightarrow FeAsO_4 + SO_2 \quad (2)$$

whereas with reasonably high oxygen potentials the reaction $$As_4 + 3O_2 \rightarrow As_4O_6(g) \quad (3)$$

accelerates the decomposition process instead.

Arsenic forms volatile compounds in both oxidic, neutral and reducing atmospheres, viz. $As_4O_6$, $As_4$, $As_4S_6$ and ($As_xS_y$).

Arsenic metal vapour is removed from the gas phase through reaction (3), at the same time as the oxygen potential is held low, $10^{-14}$–$10^{-16}$ atm, and hence this reaction further favours the elimination of arsenic. When the reactions (1) and (3) are carried out simultaneously, the iron present in the concentrate will partially oxidize in relation to the amount of air available, in accordance with the reaction $$3FeS + 5O_2 \rightarrow Fe_3O_4 + 3SO_3 \quad (4)$$

When strongly reducing conditions prevail during the decomposition process, for example as result of the use of carbon monoxide, arsenic will be vaporized as arsenic sulphide, and the iron is oxidized to magnetite.

Similar conditions are expressed when enargite is split in accordance with the reaction $$B\ 4Cu_3AsS_4 \rightarrow 6Cu_2S + As_4S_6 \quad (5)$$

at temperatures above 550° C. in a neutral atmosphere.

In an oxidizing atmosphere, the enargite is split in accordance with the reaction $$4Cu_3AsS_4 + 13O_2 \rightarrow 6Cu_2S + 10SO_2 + As_4O_6 \quad (6)$$

When excess oxygen is present there is a risk of stable non-volatile $Cu_3As$ being formed from the arsenic-rich gas phase, and in the metallic copper formed in the concentrate. This formation of copper arsenide is favoured by elevated temperatures and pronounced oxidation of sulphur.

There is also a risk of $Cu_2O$ forming, and both $Cu_3As$ and $Cu_2O$ are liable to cause sintering reactions in the bed, due to the fact that these compounds have low melting points and therefore become stickly at prevailing bed temperatures.

Antimony is best removed in the form of a sulphide or a mixture of oxide and sulphide at low oxygen potential, thereby avoiding the formation of non-volatile $Sb_2O_5$. Tests have shown that the formation of mixed gaseous compounds of arsenic and antimony-oxides favour the expulsion of antimony.

Bismuth requires high temperatures and low oxygen potential, since the oxide, $Bi_2O_3$, is non-volatile and bismuth must consequently be removed as $Bi^0$, BiS or $Bi_2S_3$.

Figure 2:
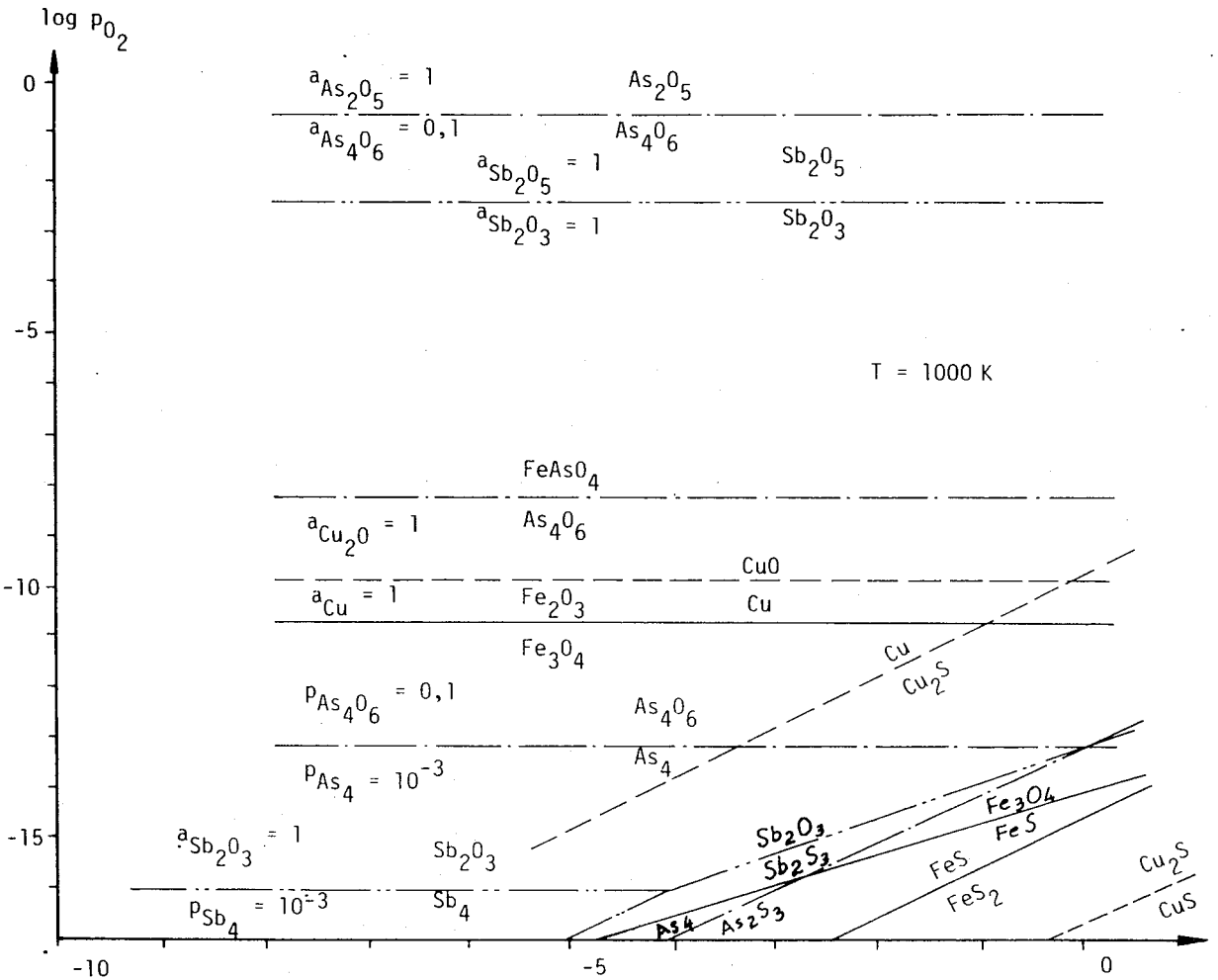

The conditions prevailing when decomposing or roasting complex minerals to eliminate arsenic, antimony and bismuth are illustrated in more detail in the diagram of FIG. 1, where the phase limits for the compounds in question are shown as a function of temperature and oxygen potential. Typical partial roasting temperatures lie in the region $T_R$, defined by broken lines. Furthermore, there is shown in a diagram in FIG. 2 the relevant phase limits for a system Me-S-O at the temperature 1000K, i.e. at a typical partial roasting temperature as a function of the oxygen and the $SO_2$ pressures, respectively. In FIG. 2 the phase limits belonging to the Fe-S-O-system as chain lines with two dots and in the Cu-S-O-system as solely broken lines.

However, a fluidized bed for partial roasting processes will not promote the establishment of equilibrium, since diffusion rates and kinetics will have a totally decisive influence. Thus, the terminal percentages in which the relevant impurities are present will be higher than that which can be expected from equilibrium diagrams and thermodynamical calculations. Admittedly, expulsion of the impurities can be accelerated by increasing the temperature to a level higher than that required for equilibrium conditions and/or by lowering the oxygen potential, by adding additional sulphur for example. When either of these expedients is employed, however, on when roasting is continued for a prolonged period of time, the risk of deleterious bed changes due to agglomeration or sintering of the concentrate soon arises, and $Cu_3As$ and similar compounds containing antimony and bismuth are liable to form, as previously mentioned. Consequently, these measures offer but a small possibility of arriving at an acceptable end product. With regard to the residence time, it must be emphasized that in a fluidized-bed reactor, although the concentrate may be heated in the bed to the relevant reaction temperatures, the reactions will essentially solely take place in the resultant particle/gas mixture which is rapidly transported through the reactor and out into the gas-cleaning system, which is normally located downstream of the reactor. The relationship between the gas phase and the solid phase influences the residence time and the diffusion distance. Instead of permitting the reactions to take place in particles entrained with the gas, as in the case of conventional fluidized-bed techniques, it is ensured, in accordance with the invention, that the reaction time is sufficiently long to obtain the degree of elimination desired, by separating solids from the gas phase, suitably in a cyclone, and returning the separated solids to the fluidized bed, thereby to increase the solids-to-gas-ratio.

Thus, according to a further characterizing feature of the method according to the invention, the oxygen potential is regulated, so as to prevent the formation of non-volatile compounds of the impurities in question, while controlling, at the same time, the length of time which the concentrate is in contact with the gas phase, so as to ensure given minimum elimination of said impurities. During the whole of this period, the aforementioned lowest decomposition temperature shall be maintained as long as the concentrate is in contact with the gas phase, i.e. right up to the moment at which the partially roasted solids are separated from the gas phase.

Thus, the reactions taking place in the reactor, i.e. expulsion and oxidation, are mainly controlled by varying the residence time, and therewith the load in $kg/Nm^3$, by returning a part of the roasted solids from the cyclone to the bed. It is also possible to control the reactions, by regulating the supply of heat to the system.

A preferred method of extending the residence time is to utilize a fluidized-bed reactor having a circulatory fluidized bed, which in practice comprises an integrated reactor and cyclone. Such a reactor is provided with a primary cyclone, enabling the roasting temperature to be maintained, and one or more secondary cyclones. Roasted solids are separated in the primary cyclone to an extent determined by the design of the cyclone, which determines, for example, the so-called cyclone efficiency. Consequently, when the normal mass and gas flows of the system are known, it is possible to dimension the cyclone to obtain a given separating efficiency. With respect to the present invention, a suitable cyclone is one having a cyclone efficiency of at least 95%, meaning that $\geqq 95\%$ of the particles passing through the cyclone are separated. In this case, roasted solids separated in the primary cyclone are recycled directly to the bed, while roasted solids from the bed and the secondary cyclone are either removed from the system or charged directly to an optional, subsequent further fluidized-bed reactor. It will be understood that in certain cases it may be desirable to carry out the method in two stages, in mutually separate reactors. When the concentrate has a high antimony content in relation to the arsenic content, it can be particularly necessary to expel the impurities in a first stage at a very low oxygen potential, and in a second stage to bring the roasted solids into contact with a gas which is less rich in arsenic and antimony and which is capable of transporting more impurities while permitting, at the same time, the final sulphide content of the roasted solids to be adjusted more readily. Since the expulsion of antimony requires a lower oxygen potential and a longer residence time than is required for the expulsion of arsenic, it will be seen that the aforegoing applies primarily to material rich in antimony.

It has now also surprisingly been found that a high arsenic content of the concentrate favours the expulsion of antimony. Thus, the expulsion of antimony is greatly improved when the ratio of arsenic to antimony in the concentrate is greater than about 20. An improvement in the elimination of antimony from 80% to 90% has been established with an arsenic/antimony ratio of about 40.

For the reasons aforementioned, it is possible in the majority of cases to obtain fully satisfactory results when roasting a concentrate of high arsenic content in a single stage, even when the concentrate is rich in antimony. Since decomposition of the complex minerals is endothermic, external heat must be supplied. Consequently, the reactor is preferably provided with means which enable the fluidizing gas to be preheated, so as to increase the flexibility of the system and enable a high variety of concentrates to be roasted. The fluidizing gas is preferably preheated to at least 300° C., before being introduced into the reactor.

As beforementioned, the oxygen potential found within the reactor is also an important process parameter. In this respect, the composition of the ingoing gas is, in the majority of cases, preferably selected so as to enable a desired oxygen potential to be maintained more readily within the reactor. For example, the gas may comprise a mixture of air and residual gases from other process units, for example residual gas from oxygem plants, coke manufacturing plants, copper smelters and similar processes.

The reactor temperature should be within the range of 600°–850° C., preferably 650°–750° C. Effective decomposition is impossible at excessively low temperatures, while excessively high temperatures result in increased risk of agglomeration and sintering in the bed.

In order to obtain a more controllable bed, a flux in the form of fine grained, silica can be added to the reactor and the concentrate, wherein the flux first stabilizes the bed and secondly is heated and removed together with the concentrate and transferred for direct use in a subsequent smelting stage.

At preferred temperatures, it is suitable to limit the oxygen potential within the reactor to a level within the range of $10^{-14}$–$10^{-16}$ atm, preferably to about $10^{-15}$ atm, since when the oxygen potential is too high, the oxygen present is excessive and is liable to diffuse into the individual concentrate particles, where magnetite and arsenic are also present. As beforementioned, this can cause iron arsenate to form, in which case arsenic will be retained in the particles.

The method according to the invention will now be described in more detail with reference to FIG. 3, which illustrates an arrangement of apparatus for carrying out a preferred method of the invention, and also to working examples, in which the method has been applied to various kinds of concentrate.

Figure 3:
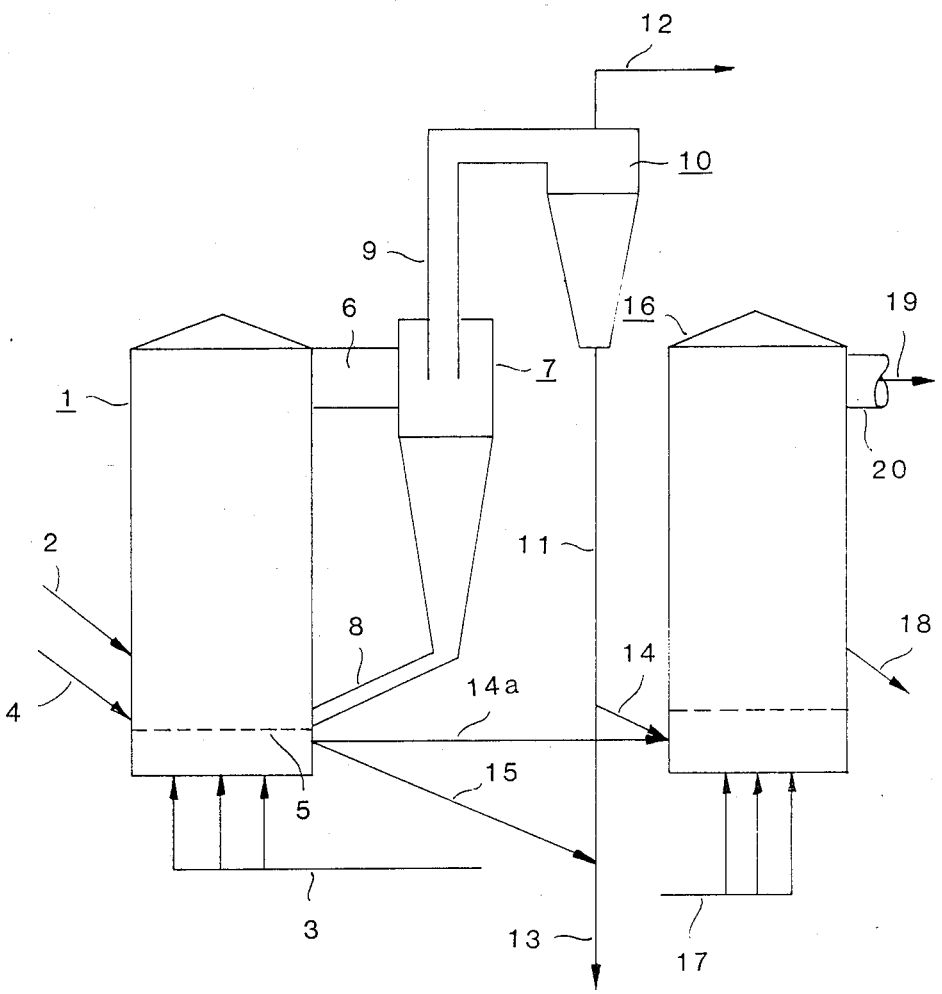

In FIG. 3 concentrate is roasted in a reactor having a circulatory fluidized bed. A reactor 1, to which concentrate is supplied through a line 2 and fluidizing-gas through lines 3, and optionally secondary gas through a line 4, is provided with a grate 5 and a gas outlet 6, through which the gas and accompanying solids are passed to a primary, heat cyclone 7, in which the major part of the solid material is separated from the gas while being held at the temperature prevailing in the reactor 1, and is returned to the reactor, through a line 8. The remainder of the solids is passed through a gas outlet 9 at the top of the heat cyclone 7, to a secondary cyclone 10, in which the remainder of the solids is separated from the gas and removed through a line 11, while the gas is passed through a line 12 to a chimney, optionally after having first passed through a cleaning and processing means, for example a Cottrel precipitator (not shown). The solids removed from the cyclone 10 may be discharged, via line 11, from the system through a line 13, together with bed material removed from the reactor 1 through a line 15. The solids from the cyclone 10 may also be passed through a line 14 to an optional second reactor 16, optionally together with bed material from the reactor 1, this bed material being supplied through a line 14*a*. Fluidizing gas is supplied to the reactor 16 through lines 17. Solids roasted to conclusion can be removed from the bed in the reactor 16 through a line 18, or can be separated from the gas in a further cyclone system (not shown), to which gas and accompanying particles are passed from the reactor 16, via a gas outlet 20, as indicated by the arrow 19.

EXAMPLE

A number of mutually different concentrates having a high arsenic content were processed in a plant of the kind described with reference to FIG. 3, although on a pilot scale. The major constituents of the concentrates are shown in the analysis set-forth in Table I.

TABLE I

| | Concentrate composition | | | | | | | | |
|---|---|---|---|---|---|---|---|---|---|
| Concentrate | % S | % As | % Sb | % Bi | % Cu | % Fe | % Zn | g/t Au | g/t Ag |
| A | 25.0 | 26.5 | — | 0.23 | 0.4 | 34.0 | 0.02 | 21 | 85 |
| B | 28.2 | 10.5 | 0.68 | 0.07 | 28.0 | 19.0 | 0.05 | 130 | 630 |
| C | 27.6 | 16.5 | 0.40 | 0.14 | 15.0 | 20.0 | 0.03 | 97 | 390 |
| D | 28.7 | 5.5 | 0.60 | 0.04 | 22.0 | 18.0 | 3.6 | 96 | 1900 |
| E | 28.0 | 12.5 | 0.60 | 0.10 | 16.0 | 19.0 | 3.0 | 90 | 1100 |
| F | 29.0 | 13.0 | — | 0.12 | 0.7 | 33.0 | 0.4 | 33 | 50 |

The pilot plant had a roasting capacity of up to 40 kg/h in one or two stages. The reactor residence time was regulated through the fluidizing rate and the level of the bed. Calcine taken from the primary cyclone 7 were recycled to the bed, so as to ensure a prolonged residence time. Calcine taken from the bed in reactor 1 and the secondary cyclone 10 were either removed as a final product or were charged directly to the second reactor 16. The different tests were carried out at a constant temperature of between 700° and 800° C., and the temperature was measured at 14 different locations in the system, and the pressure at 7 locations.

Normal minimum gas flow rates were about 15 $Nm^3/h$ in the first reactor and about 6 $Nm^3/h$ in the second reactor, corresponding to about 0.25 and 0.05 m/s NTP respectively. Calcine samples were taken from the beds and the cyclones for analysis, the results of which are illustrated for each test in the Table II below, which also discloses the selected temperature and the concentrate treated. By bed 1 and bed 2 is meant the respective beds of reactor 1 and reactor 16, while by cyclone 1 and cyclone 2 is meant cyclone 10 and 19 the cyclone to which gas flow 19 is sent as illustrated in FIG. 3.

TABLE II

| | | | | Calcine composition | | | | | | | |
|---|---|---|---|---|---|---|---|---|---|---|---|
| Test No. | Concentrate | Sampling location | T(°C.) | % S | % As | % Sb | % Bi | % Cu | % Fe | Au g/t | Ag g/t |
| 1 | A | bed 1 | 750 | 15.4 | 0.64 | — | 0.048 | 0.56 | 53 | 39 | 130 |
| | | bed 2 | 750 | 0.5 | 0.18 | — | 0.051 | 0.54 | 53 | 31 | 140 |
| | | cyclone 1 | | 1.0 | 0.63 | — | 0.077 | 1.0 | 52 | 57 | 190 |
| 2 | A | bed 1 | 800 | 13.6 | 0.25 | — | 0.034 | 0.56 | 52 | 39 | 150 |
| | | bed 2 | 800 | 0.4 | 0.15 | — | 0.029 | 0.55 | 52 | 31 | 140 |
| | | cyclone 2 | | 0.8 | 0.50 | — | 0.077 | 0.96 | 53 | 65 | 200 |
| 3 | B | bed 1 | 700 | 14.7 | 0.24 | 0.13 | 0.07 | 32.4 | 30.3 | 170 | 690 |
| | | cyclone 1 | | 15.6 | 0.42 | 0.17 | 0.08 | 30.9 | 20.8 | 170 | 790 |
| | | bed 2 | 775 | 9.1 | 0.18 | 0.10 | 0.09 | 32.5 | 41.8 | 170 | 690 |
| | | cyclone 2 | | 9.2 | 0.71 | 0.11 | 0.10 | 32.6 | 26.6 | 120 | 820 |
| 4 | C | bed 1 | 750 | 15.6 | 0.29 | 0.04 | 0.13 | 15.6 | 33.3 | 98 | 400 |
| | | cyclone 1 | | 20.2 | 0.42 | 0.06 | 0.17 | 20.2 | 30.9 | 100 | 500 |
| 5 | D | bed 1 | 750 | 10.5 | 0.51 | 0.12 | 0.04 | 25.1 | 14.6 | 112 | 2100 |
| | | cyclone 1 | | 11.6 | 0.61 | 0.18 | 0.06 | 31.8 | 19.3 | 75 | 2600 |
| 6 | E | bed 1 | 750 | 10.3 | 0.31 | 0.15 | 0.10 | 17.3 | 24.7 | 97 | 1470 |
| | | cyclone 1 | | 13.6 | 0.45 | 0.25 | 0.15 | 21.9 | 23.6 | 93 | 2000 |
| 7 | F | bed 1 | 800 | 9.3 | 0.26 | — | 0.0086 | 2.0 | 46.6 | 45 | 150 |

TABLE II-continued

| Test No. | Concentrate | Sampling location | T(°C.) | Calcine composition % S | % As | % Sb | % Bi | % Cu | % Fe | Au g/t | Ag g/t |
|---|---|---|---|---|---|---|---|---|---|---|---|
| | | cyclone 1 | | 12.0 | 1.37 | — | 0.18 | 1.41 | 48.9 | 38 | 170 |

As will be seen from Table II, tests No. 1–3 were carried out in two stages, while the remaining tests were carried out in a single stage. Arsenic was eliminated to a satisfactory extent in the first stage of all tests. In tests 1–2 the second stage was carried out at a higher oxygen potential, in order to roast-off all the sulphur present, while in the case of test 3 the concentrate was also partially roasted in the second stage, in order to study the expulsion of antimony in a 2-stage partial roasting process. In the case of the concentrates processed in these steps, it was found that satisfactorily low residual contents of arsenic could be obtained by partially roasting the concentrate in solely *one* stage. Thus, the elimination of arsenic and antimony in the first stage was highly satisfactory throughout, and it was possible to achieve residual arsenic contents of between 0.24 and 0.64% and residual antimony contents of between 0.04 and 0.15%. The bismuth contents of the calcines obtained in the first stage were between about 0.03 and 0.1%. It was possible in the second roasting stage of tests 1–3 to reduce the arsenic content still further, down to a level of 0.1–0.15%, and antimony down to 0.01%. In this stage, bismuth was only affected at high temperatures, as in test 2.

It will also be seen from the composition analysis that in the first roasting stage of all the tests at least part of the iron is still present as the sulphide FeS. This means that the oxygen potential in the first stage was at most about $10^{-14}$ atm, as will be seen from a study of FIG. 2, which illustrates the equilibrium conditions at 723° C., i.e. within the temperature range used in the tests.

In order to study the affect of the roasting process on the impurities remaining in the calcines, calcines obtained from tests 3–6 were smelted together with granulated fayalite slag at 1250° C. Samples were taken from the matte and the slag formed, and the analysis results of the samples are set-forth in Table III below.

TABLE III

| Test No. | Sample | Matte and slag composition % S | % As | % Sb | % Bi | % Cu | % Fe |
|---|---|---|---|---|---|---|---|
| 3 | Matte | 17.7 | 0.36 | 0.05 | 0.09 | 71.4 | 2.1 |
| | Slag | — | 0.26 | 0.20 | — | 1.4 | 34.3 |
| 4 | Matte | 20.2 | 0.10 | 0.05 | 0.11 | 60.9 | 12.0 |
| | Slag | — | 0.34 | 0.14 | — | 1.35 | 32.5 |
| 5 | Matte | 20.1 | 0.25 | 0.13 | 0.06 | 60.8 | 10.5 |
| | Slag | — | 0.15 | 0.09 | — | 0.92 | 41.4 |
| 6 | Matte | 22.3 | 0.31 | 0.13 | 0.12 | 43.6 | 22.7 |
| | Slag | — | 0.19 | 0.10 | — | 0.87 | 50.3 |

The arsenic, antimony and bismuth content of all of the samples taken were far below the maximum permitted in our smelter at Rönnskär. It can also be seen that a major part of the residual antimony and arsenic can be eliminated by slagging in a smelting stage, while all the bismuth present is taken up in the matte.

We claim:

1. A method for treating a sulphidic concentrate having an average particle size below 1 millimeter which concentrate is intended for further processing to recover at least one of copper and precious metals and which contains at least one mineral complex containing a contaminant selected from the group of arsenic, antimony, bismuth and mixtures thereof in quantities adversely affecting subsequent processing stages comprising:

(a) introducing the concentrate and fluidizing gas into a fluidized bed reactor;

(b) heating the concentrate to the lowest temperature exceeding the splitting or decomposition temperatures of at least one mineral complex present in the concentrate;

(c) regulating the oxygen potential in the reactor to a level within the range of $10^{-14}$ to $10^{-16}$ atmosphere by adjusting the composition of the gas introduced into the reactor so as to prevent the formation of non-volatile compounds of said contaminant;

(d) controlling the concentrate residence time in the reactor by adjusting the solids-to-gas ratio in the reactor so as to ensure substantial elimination of contaminant;

(e) removing the gas and solids from the reactor;

(f) passing said gas and solids to a separating means in which solids substantially free from contaminant are separated from the gas;

(g) maintaining the aforesaid lowest temperature and said regulated oxygen potential through-out the period over which the solids are in contact with said gas;

(h) returning at least a part of the separated solids to the reactor in order to control the residence time thereof; and (i) removing a partially roasted final product from at least one of the fluidized bed and the separating means which has an arsenic content no greater than 0.64%, an antimony content no greater than 0.15% and a bismuth content no greater than 0.1%.

2. The method of claim 1 wherein the fluidized bed reactor is a circulatory bed.

3. The method of claim 1 wherein the method is carried out in two stages in mutually separate reactors.

4. The method of claim 1 wherein the fluidizing gas is pre-heated to a temperature above 300° C.

5. The method of claim 1 wherein the composition of the gas is selected so that the oxygen potential is maintained in the reactor.

6. The method of claim 5 wherein the fluidizing gas comprises a mixture containing air.

7. The method of claim 1 wherein the temperature lies within the range of 600°–850° C.

8. The method of claim 1 wherein a fine-grained silica flux is added to the reactor and concentrate.

9. The method of claim 1 wherein the temperature lies within the range of 650°–700° C.

10. The method of claim 9 wherein the oxygen potential is maintained at about $10^{-15}$ atm.

11. The method of claim 1 wherein the concentrate has an average particle size of from 1 to 10 microns.

12. A method for treating a sulphidic concentrate having an average particle size below 1 millimeter which concentrate is intended for further processing to recover at least one of copper and precious metals and which contains at least one mineral complex containing a contaminant selected from the group of arsenic, antimony, bismuth and mixtures thereof in quantities adversely affecting subsequent processing stages comprising:

(a) introducing the concentrate and a fluidizing gas into a fluidized bed reactor;

(b) heating the concentrate to the lowest temperature exceeding the splitting or decomposition temperatures of at least one mineral complex present in the concentrate;

(c) regulating the oxygen potential in the reactor to a level within the range of $10^{-14}$ to $10^{-16}$ atmosphere by adjusting the composition of the gas introduced into the reactor so as to prevent the formation of non-volatile compounds of said contaminant;

(d) controlling the concentrate residence time in the reactor by adjusting the solids-to-gas ratio in the reactor so as to ensure substantial elimination of contaminant;

(e) removing the gas and solids from the reactor;

(f) passing said gas and solids to a separating means in which solids substantially free from contaminant are separated from the gas;

(g) maintaining the aforesaid lowest temperature and said regulated oxygen potential through-out the period over which solids are in contact with said gas; and (h) removing a partially roasted final product from at least one of the fluidized bed and the separating means which has an arsenic content no greater than −0.64%, an antimony content no greater than 0.15% and a bismuth content no greater than 0.1%.

13. The method of claim 12 wherein the concentrate has an average particle size of from 1 to 10 microns.

* * * * *

UNITED STATES PATENT AND TRADEMARK OFFICE

CERTIFICATE OF CORRECTION

PATENT NO. : 4,626,279

DATED : December 2, 1986

INVENTOR(S) : Bjornberg et al

It is certified that error appears in the above-identified patent and that said Letters Patent is hereby corrected as shown below:

Claim 12, column 12, line 18, amend "-0.64%" to --0.64%--.

Signed and Sealed this

Tenth Day of March, 1987

*Attest:*

*Attesting Officer*

DONALD J. QUIGG

*Commissioner of Patents and Trademarks*